US006142919A

United States Patent [19]

Jorgensen

[11] Patent Number: 6,142,919

[45] Date of Patent: Nov. 7, 2000

[54] MULTI-PURPOSE LOW PROFILE PHYSICAL EXERCISING DEVICE

[76] Inventor: Adam A. Jorgensen, 1911 NW. 36th St., Oakland Park, Fla. 33309

[21] Appl. No.: 09/289,898

[22] Filed: Apr. 12, 1999

[51] Int. Cl.[7] ..... A63B 21/02

[52] U.S. Cl. ..... 482/121; 482/904; 482/98

[58] Field of Search ..... 482/102, 98, 99, 482/126, 904, 129, 121

[56] References Cited

U.S. PATENT DOCUMENTS

| | | | |
|---|---|---|---|
| 403,703 | 5/1889 | Small | 482/904 |
| 511,251 | 12/1893 | Pickles | 482/129 |
| 1,965,511 | 7/1934 | Preston | 482/129 |
| 4,685,670 | 8/1987 | Zinkin | 482/904 |
| 4,749,189 | 6/1988 | Frank | 482/904 |
| 4,787,626 | 11/1988 | Gallagher | 482/904 |
| 5,403,257 | 4/1995 | Lehtonen | 482/112 |

*Primary Examiner*—Jerome Donnelly
*Attorney, Agent, or Firm*—Oltman,Flynn & Kubler

[57] ABSTRACT

A physical exercising device having a handle to be grasped by an exercising person; an elongate frame having a plurality of attachment points disposed along the frame; an elastic resistance member having one end attached to the frame and another end; a fixed pulley fixedly attached to the frame and a detachable pulley detachably connectable to any one of said attachment points; a flexible wire threaded through the fixed pulley and the detachable pulley, having a first part in operative engagement with the other end of the elastic resistance member, and another part of the wire attachable to the handle for manually applying a stretching force to the elastic resistance member by the exercising person. The physical exercising device wherein the frame is composed of a vertical stem having an upper part and a top member extending away from the top part, and wherein the attachment points are disposed along the vertical stem and the top member. The physical exercising device may further include a floating third pulley attached to the other end of the elastic resistance member, and wherein the first part of the wire is threaded through the third pulley, and the flexible wire has a distal end away from the part of the wire attached to the handle, the distal end of the wire being fixedly attached to the frame for increasing the stretching force. The physical exercising device may include in the elastic resistance member at least one strand of elastic rubber or a coil spring P.

10 Claims, 4 Drawing Sheets

MULTI-PURPOSE LOW PROFILE PHYSICAL EXERCISING DEVICE

The Invention relates to physical exercising devices, structured to enable a user to exercise different muscle groups of the body. The device is adjustable for providing different degrees of resistance according to the strength of an exercising person and of the different muscle groups to be exercised. Furthermore the device is very compact, taking up a minimal amount of space, and is therefore especially well suited for use for example in a residential environment.

BACKGROUND AND PRIOR ART

Most exercising devices of the known art are bulky and heavy and tend to generate loud thumping and clanging noises when in use and often require considerable floor space and are therefore unsuitable for use, in for example residential environments. They are often constructed for exercising only specific muscle groups. Furthermore, many of the known devices use heavy weights as resistance elements. It is accordingly a primary object of the invention to provide an exercising device that is of compact and light-weight construction, is virtually noiseless in use and is well suited to exercise several different muscle groups, and is readily adjustable to different degrees of tension as may best suit an exercising person, and it is well suited to be installed in a restricted space, such as for example a residential environment.

U.S. Pat. No. 5,403,257 by Kari Lehtonen describes a multipull exercising device based on a system of pulleys and wires and includes a resistance device to be stretched by the user thereby providing the intended exercise of the muscles of a user. This device, however does not provide the highly variable geometry, structure and adaptability to different exercises of the present invention.

Other exercising devices are known, which are based on the manipulation of a resistance device by means of wires and pulleys. However none of the known devices provide in combination the degree of universality and compactness afforded by the herein disclosed and claimed device.

BRIEF DESCRIPTION OF THE INVENTION

The present invention relates to a physical exercising device capable of being configured in various ways so as to enable a person to exercise different muscle groups of the body. Furthermore the device is adjustable for providing different degrees of resistance according to the strength of the exercising person and for providing exercise for many different muscle groups.

Most exercising devices of the known art are bulky and heavy and tend to generate loud and clanging noises when in use. They are often constructed for exercising specific muscle groups. It is accordingly a primary object of the invention to provide an exercising device that is of compact and light-weight construction. The device is virtually noiseless in use and is well suited to exercise many different muscle groups and is readily adjustable to provide different degrees of tension as may best suit an exercising person according to the exercises to be performed.

The device according to the invention is, as stated above, well suited to be used in a residential environment since it is of low weight, compact construction which can fit into a narrow space and can be pivoted out of the way e.g. up against a wall when not in use. It can be quickly configured to anyone of several configurations for exercising different muscle groups and can be adjusted to provide different tensions as desired for different users.

In its most basic form the invention includes a first and a second mutually spaced apart mounting regions, an elastic resistance element having one end attached to the first mounting region and an other end, a fixedly attached first pulley attached to the second mounting region, a handle, and a flexible line having a first end connected to the other end of the resistance element via the first pulley and the other end connected to the handle. In operation the handle is manipulated by an exercising person by stretching and relaxing the resistance element to various degrees thereby exercising various muscles of the exercising person.

In a further development of the exercising device there is provided a floating pulley which is connected to the other end of the resistance device, and wherein the first end of the flexible line has its first end connected to the second mounting region instead of to the other end of the elastic resistance member. This arrangement has the advantage that for a given stretch, i. e. elongation, of the resistance member, the handle can be pulled twice the distance of the of the elongation. It follows that the pulling force applied to the handle is therefore doubled as applied to the elastic member.

According to a further development of the invention the physical exercising device includes an elongate frame or base having two ends, e.g. an upper and a lower end, of which the lower end forms the first region and the upper end the second region. A plurality of attachment points are disposed along the frame; the elastic resistance member having one end attached to one end of the frame and another end; the fixedly attached first pulley attached to the other end of the frame, and a detachable second pulley detachably connectable to any one of the attachment points; and wherein the flexible line is threaded through the detachable pulley and the fixed pulley, having a first end of the line in operative engagement with the other end of the elastic resistance member and another end of the line attachable to the handle for manually stretching the elastic resistance member by the exercising person.

According to a further feature there is provided a physical exercising device according to the invention as described above, wherein the frame is composed of a substantially vertically oriented stem having an upper part forming the second mounting region, and a top member extending away from the upper part, and wherein the attachment points are disposed along the vertical stem and the top member.

According to a further feature, there is provided a physical exercising device according to the invention wherein the floating pulley is attached to the other end of the elastic resistance member, wherein the first end of the line is threaded through the floating pulley, the other end of the line is attachable to the handle, and the first end of the line is fixedly attached to the part of the frame opposite the end to which the one end of the resistance element is attached.

According to still another feature of the physical exercising device the elastic resistance member includes at least one string of, for example, elastic rubber.

According to a further feature of the physical exercising device, the elastic resistance member includes at least one coil spring.

According to still another feature of the physical exercising device, the elastic resistance member may include at least one weight or a pneumatic cylinder.

According to an additional feature of the physical exercising device, the attachment points are formed as loops, apertures or other suitable attachment means disposed along the vertical stem and the top member, and the second pulley has a hook, adapted to detachably engage the attachment points.

According to a still further feature the exercising device includes hinge means attached to the vertical stem for pivotally attaching the vertical stem to a vertical supporting structure such as for example a wall.

According to still another feature, the physical exercising device includes a fourth pulley multiply ganged with said floating pulley for increasing the pulling force acting on said elastic resistance member.

According Lo again another feature, the physical exercising device according to the invention includes a pre-stressing or biasing element having a first part attached to the frame and another part engaging the other end of the elastic resistance member for pre-stressing the elastic resistance member.

Further objects and advantages of this invention will be apparent from the following detailed description of the presently preferred embodiment which is illustrated schematically in the accompanying drawings.

DESCRIPTION OF THE PREFERRED EMBODIMENTS

Figure 1:
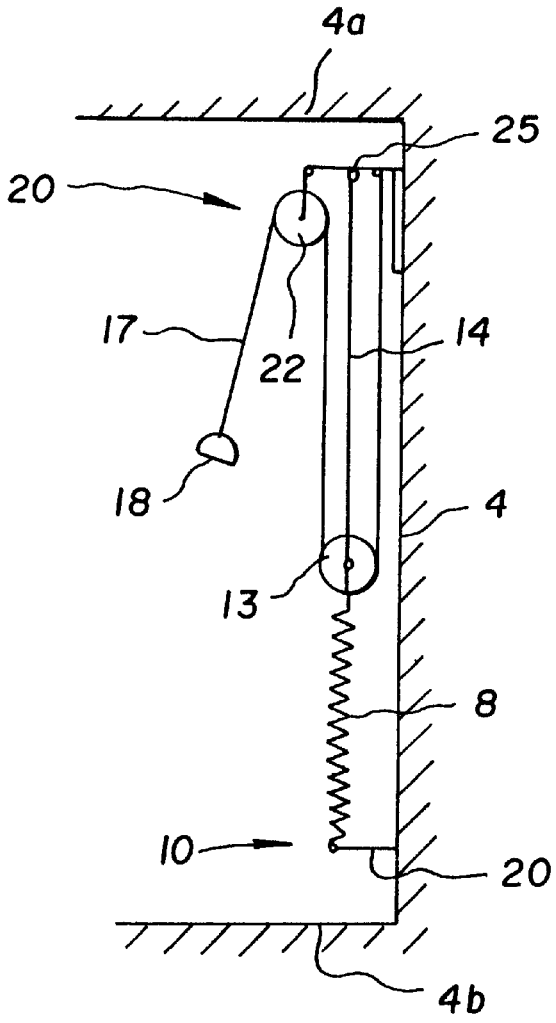
FIG. 1 is a diagrammatic view of the invention in its most basic form, showing the upper and lower mounting region, and the fixedly connected pulley and the floating pulley.

FIG. 1 shows the invention in a basic configuration including a fixed support structure including for example a wall 4, a ceiling 4*a*, and a floor 4*b*. The first mounting region 10 is shown in the form of a wall-mounted bolt or bracket 20, and an upper bracket 25 also mounted in the wall 4, which represents the upper mounting region 20. A fixed pulley 22 is fixedly attached to bracket 25. A floating pulley 13 is attached to an elastic resistance element 8, which is attached at its one end to bolt 20 in the first mounting region 10, and at its other end to the floating pulley 13. A bias string 14, connected at its one end to bracket 25, is also connected to the floating pulley 13 and serves to maintain the elastic element in a pre-stressed or biased condition. A flexible line 17 is connected at one end to handle 18 and is threaded through the fixedly mounted pulley 22 and the floating pulley 13 and is connected at its other end to the bracket 25. A pull at the handle 18 extends the handle 18 a certain distance d against the pull of the resistance member 8 with a force f, while the resistance member is extended by an distance equal to ½ d and exerting a force equal to 2f on the resistance member. It follows that the two mounting members 20, 25 can be realized in other ways, e.g. as hooks or eye bolts mounted in the ceiling 4*a* and/or the floor 4*b*.

Figure 2A:
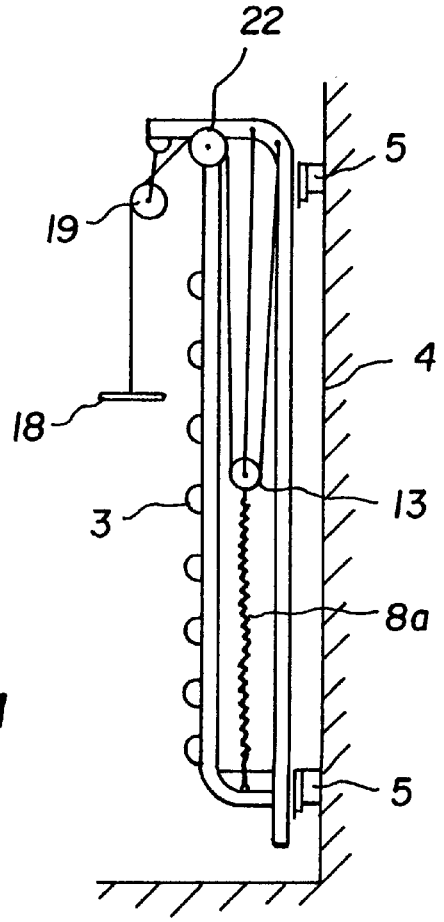
FIG. 2*a* shows the vertical stem of the invention configured as a rectangular open frame.
Figure 2:
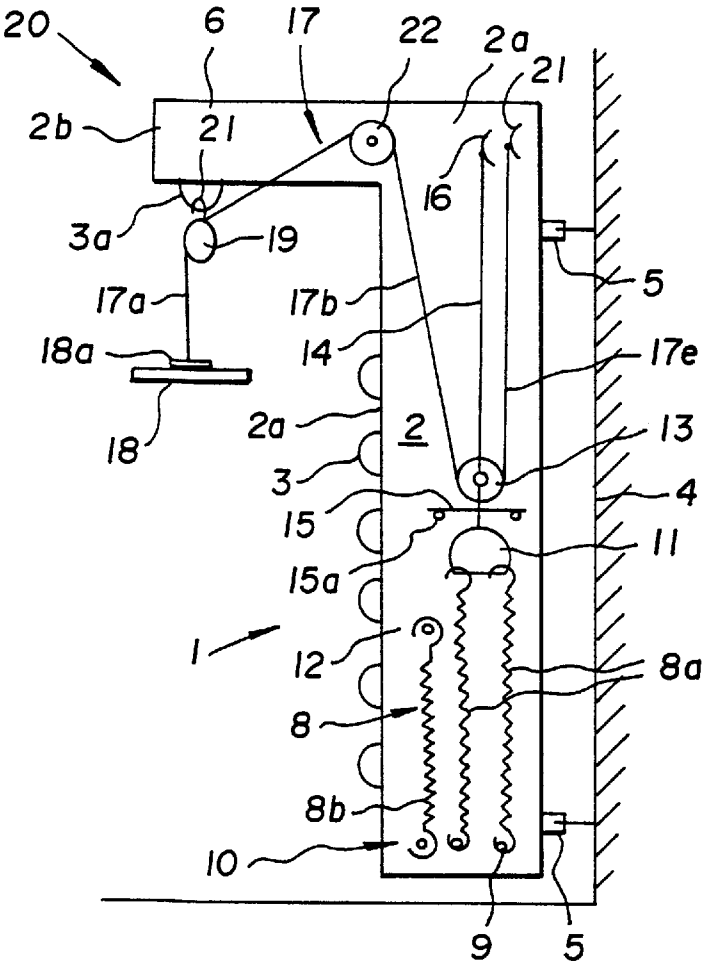
FIG. 2 is a side elevation of the invention seen attached to a vertical support structure, and showing the major components of the invention; especially characterized by having the resistance element disposed at the bottom end of the first mounting region and the vertical stem.

FIG. 2 shows the invention in elevation in another one of its preferred embodiments. An elongate frame generally at 1 includes a vertical stem 2 having an upper part 2*a* from which a top member 6 extends away from the upper part 2*a*. The frame 1 is pivotally attached to a fixed structure 4 such as a wall, an upstanding support or the like by means of hinges 5.

FIG. 2*a* shows the invention wherein the vertical stem is configured as an open frame hinged to the support structure 4. The frame may advantageously be constructed of welded tubular elements.

A plurality of attachment points 3, e.g. in the form of loops, or holes formed in the stem 2, or stubs or the like are arranged along the forward edge 2*a* of the stem 2 and to the top member 6, which is shown as having a downward facing attachment loop 3*a* at its foremost end 2*b*. A fixed pulley 22 is attached to the top part 2*a* of the stem 2 and communicates via a flexible line 17 with a detachable pulley 19 and a floating pulley 13, which engages a coupling element, e.g. in the form of a stirrup-like device 11, which couples the floating pulley 13 to the resistance element 8. The loops 3, 3*a*, serve as attachment points for the detachable pulley 19, which has a hook 21, shown in more detail in FIG. 5, that fits in the attachment points 3, 3*a*. The detachable pulley 19, FIG. 5 can be attached by means of hook 21 to different loops 3 or 3*a* as desired for different exercises. The hook 21 may have a spring-loaded latch 21 a that secures the hook 21 from accidentally disengaging from any attachment point or loop 3, 3*a*.

An elastic resistance member shown generally at 8, is in its preferred embodiment composed of at least one elastic strap 8*a*, but preferably a plurality of elastic straps 8*a*, all attached at one end by means of hooks or eyes to attachment points 9 at the bottom end of the stem 2. A number of the straps are attached at their respective upper ends to a stirrup-shaped coupler or connector 11 which is, in turn, connected to the floating pulley 13. One or more straps 8 may be disengaged at one end from the connector 11 and "parked" on at least one parking location 12 such as a stud or an eyebolt mounted on the stem 2. It follows that the total pull of the straps 8 on the coupler 11 can be regulated by placing some of the straps in the stirrup and the remainder in the parking location 12. The elastic straps 8 may be made of rubber and each equipped with a hook at each end. Such straps are known colloquially as "bung cords". Alternatively the straps may be made as coil springs or compressed air cylinders containing a piston acting against compressed air. Still other configurations of resistance elements may be used. Where possible, the resistance element 8 may be configured in well-known manner as a weight advantageously formed in sections to provide downward pull on the third, floating pulley 13, but weights, as described above, have certain disadvantages.

The flexible line or cord 17, preferably made of non-stretching material, includes sections 17*a* between handle 18 and detachable pulley 19, 17*b* between fixed pulley 22 and floating pulley 13, and 17*c* connected between floating pulley 13 and a fixed attachment point 21, formed e.g. as a cleat 21 attached to the upper end of stem 2. The handle 18, used to manually operate the exercising device, is connected to one end 18*a* of the wire 17, which is threaded via the detachable pulley 19 through the fixed second pulley 22, and from there through the floating pulley 13 to the attachment point or cleat 21 on the frame 1 near the upper end 2*a* of stem 2. The floating third pulley 13 is engaged by means of a pre-stressing or bias string 14 to a cleat 16 mounted on the top part of the frame 1. The handle 18 is advantageously equipped with a small cleat 18*a* as shown in FIG. 1 for readily attaching the line 17*a* at various locations on the line as required for different exercises.

The bias arrangement, such as e.g. string 14 serves an important function in that it provides a certain amount of biasing pre-stress or pre-stretching of the resistance elements 8*a*. In that way a more uniform pulling force as applied via the floating third pulley 13 and the stirrup 11 to the handle 18 is attained, since an initial pulling force applied manually to the handle 18 must first overcome the biasing pre-stress. Also, by lengthening or shortening the bias string 14 the total pull acting on the handle 18 can be regulated. Other biasing means may be provided, e. g. in the form of an upward-acting stop 15*a* engaging the pulley 13 or coupler 11, shown diagrammatically as a cross-arm 15, being a rigid part of floating pulley 13, resting against the two stops 15*a* attached to the stem 2.

Figure 3:
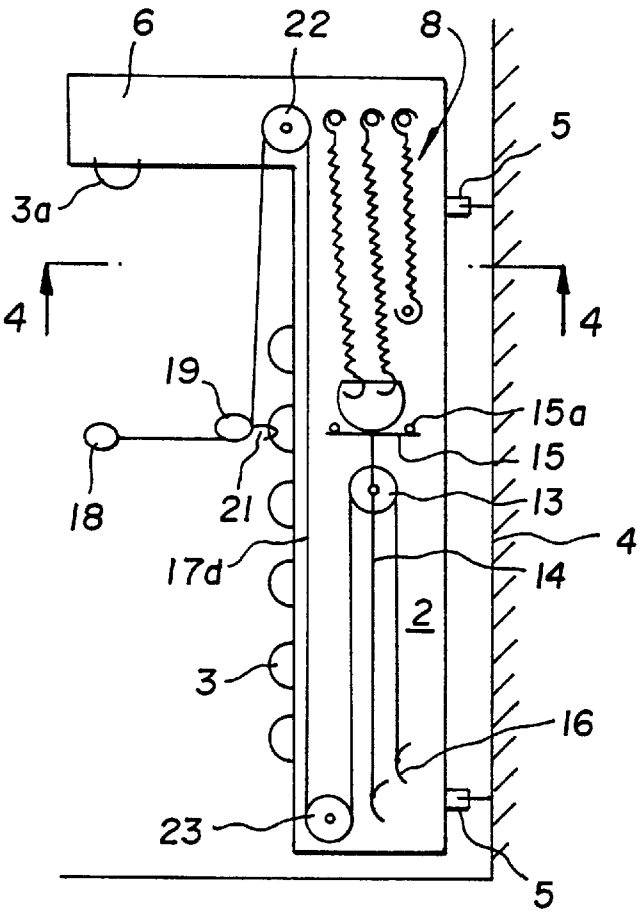
FIG. 3 is a side elevation of the invention in another arrangement of the components, showing the resistance element disposed at the second mounting region at the top end of the vertical stem.

FIG. 3 shows an embodiment of the invention, which is quite similar to the one shown in FIG. 1 with the exception that the resistance elements 8 are located at the top of the stem 2 facing downward instead of upward. For that reason a fourth pulley 23 has been added at the bottom of the stem 2 connected via an additional section of the wire 17*d* in order to enable the resistance element 8 to communicate with the handle 18, which in this figure is shown connected via the detachable pulley 19 to one of the attachment points 3. In all other respects the embodiment of FIG. 2 is similar to that of FIG. 1.

Figure 5:
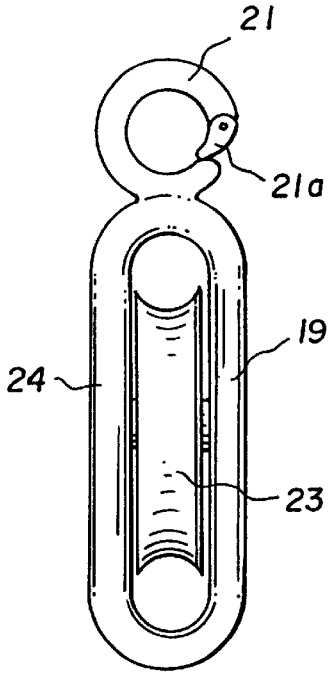
FIG. 5 is a diagrammatic view of a pulley encased in a block equipped with a hook with a spring-loaded latch.

In FIG. 5 the pulley 19 is shown in an edge view with a line wheel 23 mounted in a box frame 24 forming at one end the hook 21, which may advantageously have a spring-loaded latch 21*a*, to prevent it from accidentally disengaging from one of the attachment points 3.

Figure 7:
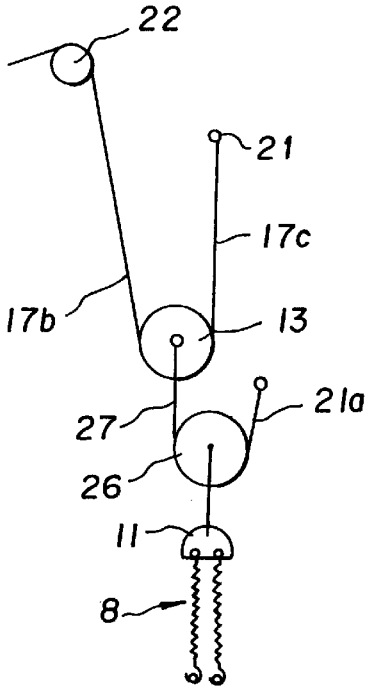
FIG. 7 shows in diagrammatic form an example of a ganged pulley arrangement, providing Additional pulling force on the resistance element.

In nautical language such an assembly is known as a "block". It may have several wheels side by side or one above the others. With such assemblies it is possible to provide "ganged pulleys" wherein the pulling force may be ganged by a factor of 3 or 4 or more in well-known manner. Such an arrangement is shown in FIG. 7, wherein another pulley 26, ganged with the third pulley 13 via wire sections 27, 21*a* provides four times the pulling force on elastic straps 8.

In one embodiment of the invention the extension 6 may be vertically adjustably attached to the stem 2 so as to be able to accommodate exercising persons of different height. It follows that a similar effect may be attained by supplying a link between the detachable pulley 19 and the attachment point 3*a*.

Figure 4:
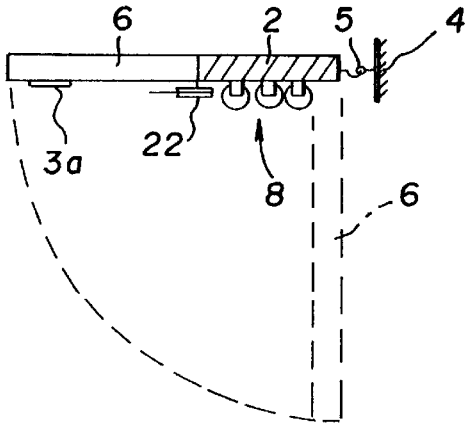
FIG. 4 is a bottom-up cross-sectional view of the invention seen along the line 4—4 of FIG. 3, showing in dashed lines the device pivoted out of the way toward the support structure.

FIG. 6 details a–d show as examples four different modes of exercises that are readily performable with the invention. In detail 5 the person sits on a low stool 29 and operates the handle 18 with the detachable pulley 19 attached to an attachment point low on the frame 1. An auxiliary string 28, shown as a dash-dot-dash line, is attached between the top attachment point 3*a* and serves to control the position of the handle as the person pushes the handle 18 in and out with his legs. In detail b the pulley 19 is placed low on the frame 1, and the person pulls the handle 18 up and down to exercise his arm pulling muscles. I detail d the person has attached pulley 19 slightly above his shoulder and pushes the handle forward with his arms to exercise his pushing arm muscles. In detail d he has attached the pulley 19 at the overhead position and moves the handle up and down to exercise his shoulder muscles. It is believed to be clear that many other exercising positions can be set up and that virtually any part of the body can be exercised with this invention. At the end of the exercise the frame can be pivoted back against the wall 4 or any other supporting structure and out of the way as shown in FIG. 4. It is also to be noted that by suitable arrangement of the hinges 5 the device can be readily arranged to be detached from the wall at the hinges 5 and moved to another exercise location pre-arranged with matching hinge parts if the hinge is constructed to be readily separated.

Figure 8:
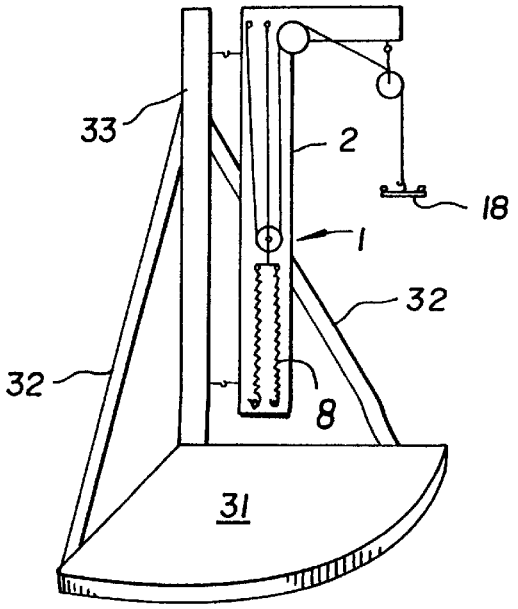
FIG. 8 shows a platform and a stayed upright as an alternative method of mounting tile invention.
Figure 6A:
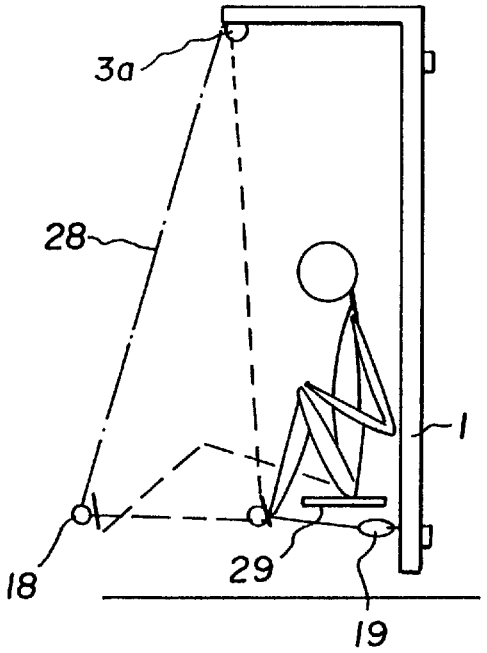
FIGS. 6*a–d* show in diagrammatic form examples of various exercises that can be performed with the invention.
Figure 6B:
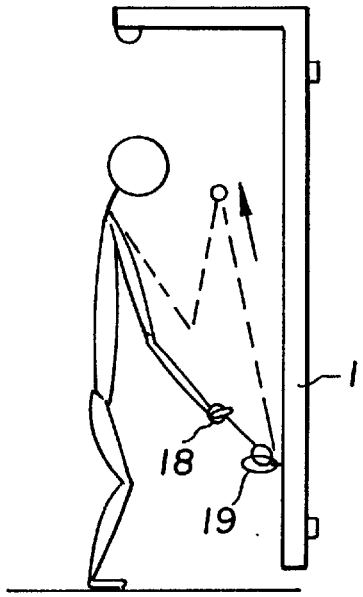
Figure 6C:
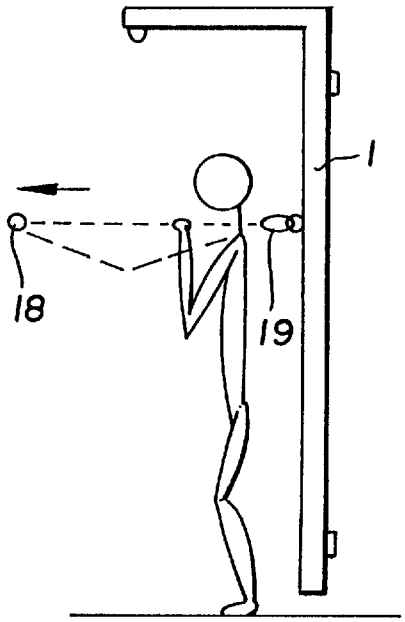
Figure 6D:
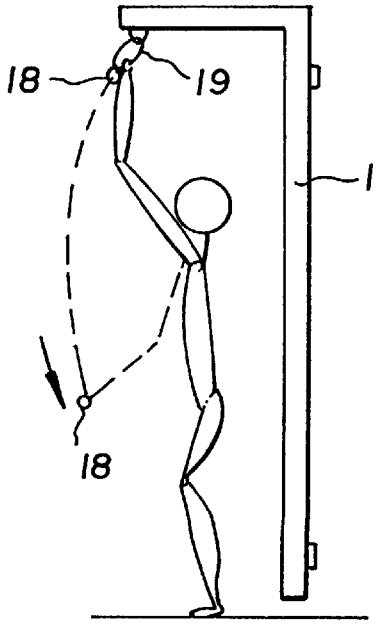

FIG. 8 shows a support structure that can be used in places wherein a fixed support structure is not readily available. It shows a horizontal platform 31 in the form of a quarter circle segment having at its center an upright post 33 for supporting the exercising device. The upright 33 is attached to the platform at its center and is supported by two stays 32, each attached at an upper end to the upright 33 and at the bottom end to respective radii of the platform 31.

What is claimed is:

1. A physical exercising device comprising:

a handle to be grasped by an exercising person;

an elongate frame having a plurality of attachment points disposed on said frame;

an elastic resistance member having one end attached to the frame and an other end;

a fixed pulley fixedly attached to the frame and a detachable pulley detachably connectable to anyone of said attachment points; and a flexible wire threaded through said fixed pulley and said detachable pulley, having a first part in operative engagement with said other end of said elastic resistance member, and another part of the wire attachable to said handle for manually applying a stretching force to said elastic resistance member by the exercising person, wherein said frame is composed of a vertical stem having an upper part and a top member extending away from said upper part, and a plurality of attachment points disposed along said vertical stem and said upper part; including a floating pulley attached to said other end of said elastic resistance member, and wherein said first part of said flexible wire is threaded through said floating pulley, said flexible wire having a distal end away from said first part of the wire, said distal end of the wire being fixedly attached to said frame for increasing said stretching force; pre-stressing means for applying a pre-stressing bias force to said elastic resistance member; and wherein said pre-stressing element includes a wire having a first end attached to the frame and an other end engaging the other end of the elastic resistance member for pre-stressing said elastic resistance member.

2. A physical exercising device according to claim 1, wherein said elastic resistance member includes at least one strand of elastic rubber.

3. A physical exercising device according to claim 1, wherein said elastic resistance member includes at least one coil spring.

4. A physical exercising device according to claim 1, wherein said elastic resistance member includes at least one weight.

5. A physical exercising device according to claim 1 including hinge means attached to said vertical stem for hingedly attaching said vertical stem to a vertical structure.

6. A physical exercising device according to claim 1, including at least one further pulley multiply ganged with said floating pulley for increasing the pulling force acting on said elastic resistance member.

7. A physical exercising device according to claim 1, comprising pre-stressing means for applying a pre-stressing bias force to said elastic resistance member.

8. A physical exercising device according to claim 1 including a support structure for supporting said frame, said support structure including a platform, an upright post.

9. A physical exercising device comprising:

a handle to be grasped by an exercising person, an elongate frame having a plurality of attachment points disposed on said frame;

an elastic resistance member having one end attached to the frame and an other end;

a fixed pulley fixedly attached to the frame; and a detachable pulley detachably connectable to any one of said attachment points; and a flexible wire threaded through said fixed pulley and said detachable pulley, having a first part of the wire in operative engagement via said floating pulley with said other end of said elastic resistance member, and another part of the wire attachable to said handle for manually applying a stretching force to said elastic resistance member by the exercising person; wherein said frame is composed of a vertical stem having an upper part, and a top member extending away from said upper part, said a plurality of attachment points being disposed along said vertical stem and said upper part; including a floating pulley attached to said other end of said elastic resistance member, and wherein said first part of said flexible wire is threaded through said floating pulley, said flexible wire having a distal end away from said first part of the wire, said distal end of the wire being fixedly attached to said frame for increasing said stretching force; prestressing means for applying a pre-stressing bias force to said elastic resistance member; wherein said pre-stressing means include a wire having a first end attached to the frame and another end engaging the other end of the elastic resistance member for pre-stressing said elastic resistance member, and wherein said pre-stressing element includes a crossbar rigidly attached to said floating pulley, and at least one stop attached to said frame and engaging said crossbar for stopping said floating pulley in pre-stressed condition.

10. A physical exercising device comprising:

a handle to be grasped by an exercising person;

an elongate frame having a plurality of attachment points disposed on said frame;

an elastic resistance member having one end attached to the frame and an other end;

a fixed pulley fixedly attached to the frame and a detachable pulley detachably connectable to anyone of said attachment points;

a flexible wire threaded through said fixed pulley and said detachable pulley, having a first part in operative engagement with said other end of said elastic resistance member, and another part of the wire attachable to said handle for manually applying a stretching force to said elastic resistance member by the exercising person; wherein said frame is composed of a vertical stem having an upper part and a top member extending away from said upper part, said plurality of attachment points being disposed along said vertical stem and said upper part; a floating pulley attached to said other end of said elastic resistance member, and wherein said first part of said flexible wire is threaded through said floating pulley, said flexible wire having a distal end away from said first part of the wire, said distal end of the wire being fixedly attached to said frame for increasing said stretching force; and wherein said detachable pulley has a hook, adapted to detachably engage any one of said attachment points.

* * * * *